US006561637B2

(12) United States Patent
Hino

(10) Patent No.: US 6,561,637 B2
(45) Date of Patent: May 13, 2003

(54) INK JET HEAD HAVING BUFFER TANK IN FLUID COMMUNICATION WITH INK CIRCULATION PATHWAY

(75) Inventor: Motohito Hino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/899,835

(22) Filed: Jul. 9, 2001

(65) Prior Publication Data

US 2003/0007049 A1 Jan. 9, 2003

(30) Foreign Application Priority Data

Jul. 6, 2001 (JP) ..... 2001-206247

(51) Int. Cl.[7] ..... B41J 2/19
(52) U.S. Cl. ..... 347/92
(58) Field of Search ..... 347/92, 89, 85, 347/86, 87

(56) References Cited

U.S. PATENT DOCUMENTS

| | | | | |
|---|---|---|---|---|
| 4,380,770 A | | 4/1983 | Maruyama | 347/29 |
| 5,815,183 A | * | 9/1998 | Sasaki | 347/86 |
| 6,022,102 A | * | 2/2000 | Ikkatai et al. | 347/85 |
| 6,152,559 A | * | 11/2000 | Kojima | 347/89 |
| 6,213,601 B1 | * | 4/2001 | Akuzawa et al. | 347/89 |
| 6,224,201 B1 | | 5/2001 | Shigemura | 347/93 |
| 6,231,174 B1 | * | 5/2001 | Haigo | 347/89 |

FOREIGN PATENT DOCUMENTS

| | | | |
|---|---|---|---|
| JP | 11-179932 | | 7/1999 |
| JP | 2000-033714 | * | 2/2000 |
| JP | 2000-318187 A | | 11/2000 |

* cited by examiner

*Primary Examiner*—Michael Nghiem
(74) *Attorney, Agent, or Firm*—Oliff & Berridge PLC

(57) ABSTRACT

To eliminate influence of air bubbles introduced into an ink jet head along with ink, an ink circulation pathway is provided which includes first to third ink channels. The first ink channel is connected between the sub-tank and a buffer tank to supply ink in the sub-tank to the buffer tank. The buffer tank is provided in a head unit to be mounted on an ink jet printer body. The second ink channel is connected between the buffer tank and the sub-tank. Any air or bubbles that have accumulated at the upper portion of the buffer tank can be discharged to the sub-tank by the pumping operation of a buffer purge pump disposed in the second ink channel. The third ink channel is connected between an ink cartridge and the sub-tank, and ink stored in the ink cartridge is supplied to the sub-tank through the third ink channel by the pumping operation of a ink supply pump disposed in the third ink channel when the ink stored in the sub-tank has gone below a certain fixed amount.

21 Claims, 7 Drawing Sheets

INK JET HEAD HAVING BUFFER TANK IN FLUID COMMUNICATION WITH INK CIRCULATION PATHWAY

BACKGROUND OF THE INVENTION

1. Field of the Invention

The present invention relates to an ink jet printer, and more particularly to a head unit detachably mounted on an ink jet printer body.

2. Description of the Related Art

Ink jet printers have been known and extensively used in the art. Typically, a head unit is detachably mounted on an ink jet printer body. The head unit includes a plurality of ink chambers and a plurality of nozzles in fluid communication with respective ones of the plurality of ink chambers.

U.S. Pat. No. 4,380,770 to Maruyama discloses an ink jet printer including pumped-forced circulation of ink through the printer head and a nozzle cap which together eliminate gas from the ink supply and overcome ink stagnation which adversely affect printing quality.

Because the ink chamber and the nozzle are of a fine structure, forced circulation is insufficient to eliminate fine bubbles once they are introduced into the ink chamber and generated in the ink circulation pathway.

SUMMARY OF THE INVENTION

The present invention has been made to solve the aforementioned problems, and accordingly it is an object of the invention to provide a head unit and an ink jet printer on which the head unit is mounted, wherein occurrence of defective printing due to air bubbles mixed with ink can be prevented.

To achieve the above and other objects, there is provided a head unit detachably mounted on an ink jet printer body. The head unit includes an ink head formed with a plurality of ink chambers and a plurality of nozzles. The nozzles are fluidly connected to respective ones of the ink chambers individually. The head unit further includes a manifold, a buffer tank, and an ink supply channel. The manifold is fluidly connected to the plurality of ink chambers so that ink is supplied from the manifold to the plurality of ink chambers. The buffer tank is defined by a ceiling wall, side walls, and a bottom wall. The ink supply channel is fluidly connected between the buffer tank and the manifold. Ink stored in the buffer tank is supplied to the manifold and the ink in the manifold is in turn supplied to the plurality of ink chambers for allowing ink droplets to be ejected from the plurality of nozzles.

The manifold is positioned below the buffer tank and the ink head is positioned below the manifold when the head unit is disposed in an orientation in which the head unit is intended to be used.

The bottom wall of the buffer tank is formed with a first aperture The manifold has an upper surface formed with a second aperture. The ink supply channel is provided between the first aperture and the second aperture. In the ink supply channel, a filter is disposed.

The inner surface of the ceiling wall is formed with a curved surface or with a slanted surface that intersects an imaginary horizontally extending plane. So the inner surface of the ceiling wall has an uppermost portion in which an outflow port is formed for removing air and ink mixed with bubbles from the buffer tank.

An ink introduction port is formed in the buffer tank for introducing ink into the buffer tank. The ink introduction port is disposed near to the inner surface of the bottom wall. The ink introduction port is made from a hollow tubular wall, which is formed in the ceiling wall to protrude downward into the buffer tank.

The ink jet printer body is provided with an ink circulation pathway. The buffer tank provided in the head unit is brought into a fluid communication with the ink circulation pathway when the head unit is mounted on the ink jet printer body.

An ink introduction port is formed in the buffer tank for introducing ink into the buffer tank. An introduction tube is fluidly connected to the ink introduction port for introducing ink into the ink introduction port. An introduction joint is provided which has one end fluidly connected to the introduction tube and another end fluidly connected to the ink circulation pathway provided in the ink jet printer body. Ink supplied from the ink circulation pathway is introduced into the introduction tube via the introduction joint. An outflow port is formed in the buffer tank, and an outflow tube is fluidly connected to the outflow port for removing air and ink mixed with bubbles from the buffer tank. An outflow joint is provided which has one end fluidly connected to the outflow tube and another end fluidly connected to the ink circulation pathway provided in the ink jet printer body. The air and ink mixed with bubbles are fed back into the ink circulation pathway via the outflow joint. Another end of the introduction joint is brought into connection with the ink circulation pathway, and another end of the outflow joint is brought into connection with the ink circulation pathway when the head unit is mounted on the ink jet printer body. On the other hand, another end of the introduction joint is disconnected from the ink circulation pathway, and another end of the outflow joint is disconnected from the ink circulation pathway when the head unit is detached from the ink jet printer body.

The introduction joint and the outflow joint have openings facing the ink jet printer body. The openings configure an imaginary plane that intersects an imaginary horizontal plane. Preferably, a casing is disposed below the openings of the introduction joint and the outflow joint to receive dripping ink.

The ink jet printer body includes an ink cartridge detachably mounted on the ink jet printer body, a sub-tank supplied ink from the ink cartridge, an ink supply pump, and a buffer purge pump. A first ink channel supplies the ink of the sub-tank to the buffer tank provided in the head unit. A second ink channel feeds back the ink stored in the buffer tank to the sub-tank. The buffer purge pump is disposed in the second ink channel to generate a flow of ink from the buffer tank to the ink supply source when driven and to interrupt the flow of ink when stopped. The buffer purge pump is stopped when ink droplets are ejected from any one of the plurality of nozzles. The third ink channel fluidly connects the ink cartridge with the sub-tank. The ink supply pump is disposed in the third ink channel to generate a flow of ink from the ink cartridge to the sub-tank when driven and interrupt the flow of ink when stopped.

A joint is provided which has a first inlet, a second inlet and an outlet. The third ink channel is divided into a first part and a second part, and the first part is connected at one end to the ink cartridge and another end to the first inlet. The second part is connected at one end to the outlet and another end to the sub-tank. The second ink channel is divided into a first part and a second part, and the first part of the second ink channel is connected at one end to the buffer tank and another end to the second inlet. The second part of the first ink channel is commonly used as the second part of the second ink channel.

A suction cap is further provided, which is movable toward the ink head to hermetically seal the plurality of nozzles. A suction pump is connected to the suction cap to suck ink in the plurality of ink chambers through the suction cap. The buffer purge pump interrupts the flow of ink when the suction pump is sucking ink in the plurality of ink chambers through the suction cap.

BRIEF DESCRIPTION OF THE DRAWINGS

The particular features and advantages of the invention as well as other objects will become apparent from the following description taken in connection with the accompanying drawings, in which:

FIG. 5(*b*) is a cross-sectional view showing the structure of the ink jet printer on which the head unit shown in FIG. 5(*a*) is mounted;

FIG. 5(*c*) is a cross-sectional view showing the head unit mounted on the ink jet printer;

DETAILED DESCRIPTION OF THE PREFERRED EMBODIMENTS

Figure 1:
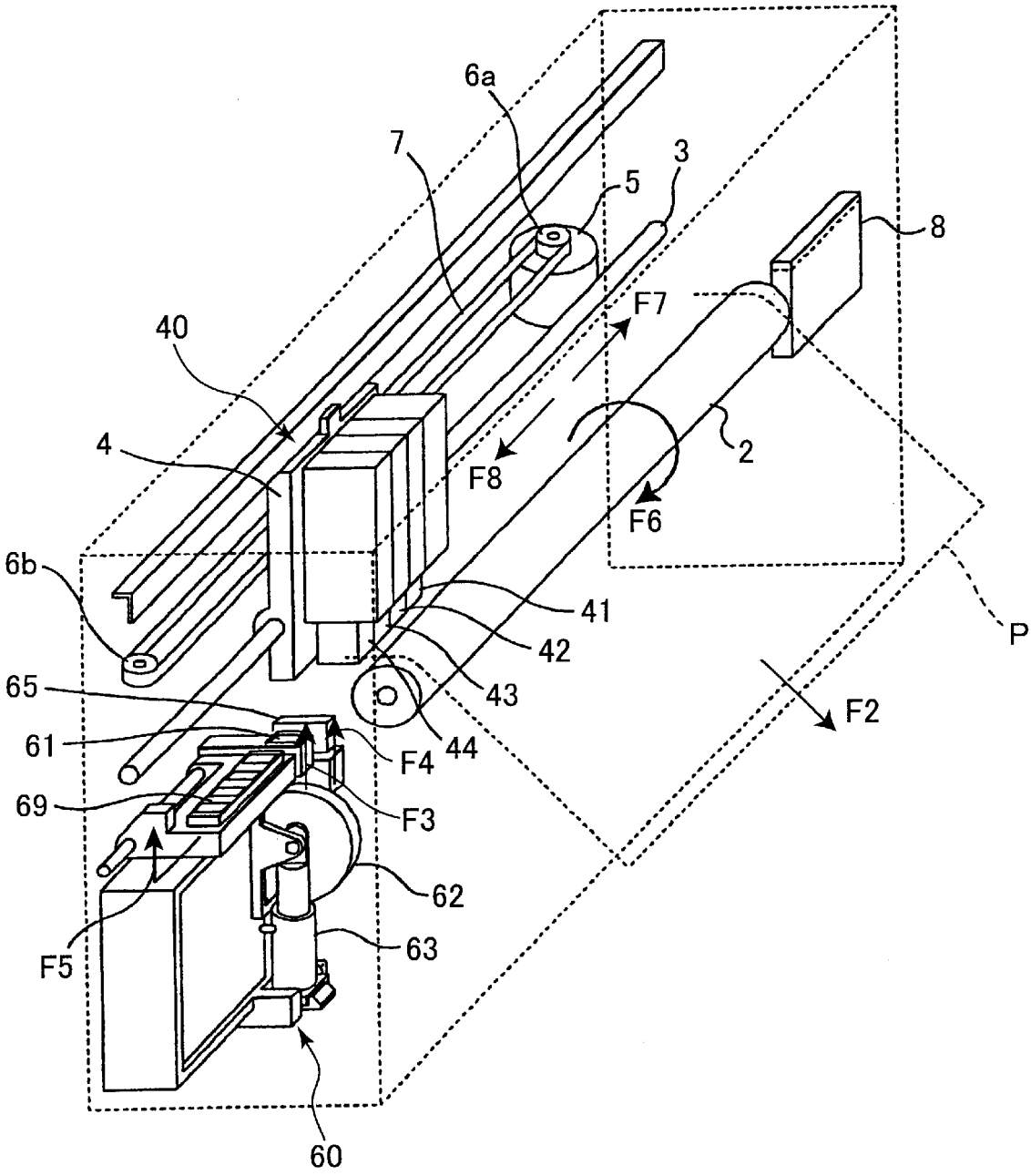
FIG. 1 a perspective view showing a part of the inner structure of an ink jet printer according to an embodiment of the invention.

An ink jet printer according to the preferred embodiment of the invention will be described with reference to the accompanying drawings. FIG. 1 is a perspective view showing a part of the inner structure of the ink jet printer according to the embodiment of the invention. The terms "upward", "downward", "upper", "lower", "above", "below", "beneath" and the like will be used throughout the description assuming that the ink jet printer is disposed in an orientation in which it is intended to be used. In use, the printer is disposed as shown in FIG. 1. An ink jet head 40 ejects ink droplets downwardly toward a printing sheet P, which is held horizontally beneath the head 40.

The ink jet printer includes a platen roller 2 that is rotatable about its own axis in a direction indicated by arrow F6. In accordance with the rotations of the platen roller 2, the printing sheet P is transported in the direction indicated by arrow F2. A carriage rod 3 is disposed in the vicinity of and in parallel with the platen roller 2. The printing sheet P passes the space between the platen roller 2 and the carriage rod 3. A carriage 4 on which the ink jet head 40 is mounted is slidably movably supported on the carriage rod 3. A carriage motor 5 is disposed near one side of the carriage rod 3. A pulley 6*a* is fixedly attached to the driving shaft of the carriage motor 5. Another pulley 6*b* is fixedly disposed near another side of the carriage rod 3. Between the two pulleys 6*a* and 6*b*, an endless belt 7 is stretched. The carriage 4 is fixed to the endless belt 7 so that the carriage 4 slidably reciprocates along the carriage rod 3 in the directions indicated by arrows F7 and F8 in accordance with rotations of the carriage motor 5.

Figure 2:
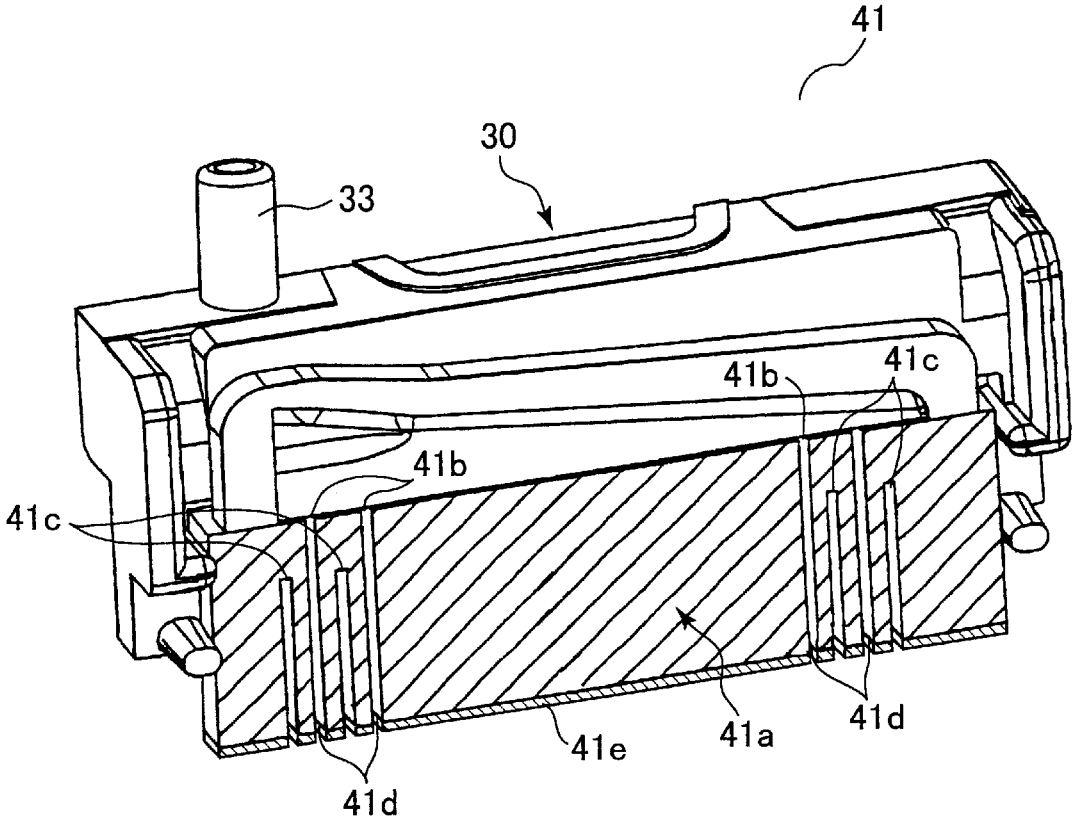
FIG. 2 is a cross-sectional view showing an ink jet head of the ink jet printer according to the embodiment of the invention.

The ink jet head 40 includes a black ink head 41 for ejecting black ink, a yellow ink head 42 for ejecting yellow ink, a cyan ink head 43 for ejecting cyan ink, and a magenta ink head 44 for ejecting magenta ink. FIG. 2 shows a detailed structure of the black ink head 41. Another ink heads have also the same structure. As shown therein, the ink head 41 includes an actuator 41*a* and a manifold 30. The actuator 41*a* is rectangular in shape and formed of a deformable material, such as a piezoelectric ceramic, for ejecting black ink droplets. As shown, one surface of the actuator 41*a* is formed with a plurality of ink chambers 41*b* and a plurality of dummy ink chambers 41*c* arranged parallel to one another at prescribed intervals, each extending in the ejection direction.

Each of the ink chambers 41*b* has an ink inlet in fluid communication with the manifold 30 on one end, and the other end is in fluid communication with a nozzle 41*d* The ink chamber 41*b* is also provided with an electrode (not shown) for ejecting ink droplets from the ink chamber 41*b* through the nozzle 41*d*.

Referring back to FIG. 1, an ink absorption pad 8 made from a porous material is disposed beyond one end of the platen roller 2, at a position beyond the printable range on the printing sheet P. The ink absorption pad 8 is provided for absorbing ink ejected from the heads 41 to 44 at the time of flushing. Flushing is carried out for the purpose of discharging bubbles contained in the ink. The bubbles enter through the nozzles when a suction cap 61 is opened during suction purge. Flushing is also carried out at a predetermined interval in order to preserve ink ejection capability, which may otherwise be lost because ink in the nozzles dries out.

A purging device 60 is disposed beyond the opposite end of the platen roller 2 from the absorption pad 8, also at a position beyond the printable range on the printing sheet P. The purging device 60 is provided for restoring heads 41 to 44 that eject poorly or not at all to a good ejecting condition, The purging device 60 includes the suction cap 61. The suction cap 61 faces the ink jet head 40 when the ink jet head 40 reaches a purging position. At this time, the rotation of a cam 62 protrudes the suction cap 61 in the direction indicated by arrow F3 in FIG. 1 so as to selectively cover the nozzle surface of the heads 41 to 44. A suction pump 63 is driven to generate a negative pressure in the suction cap 61, thereby sucking defective ink, which includes air bubbles from the ink chambers of the heads 41 to 44, from the nozzles so that the heads are restored to properly functioning condition.

A wiper member 65 is provided at one side of the suction cap 61 nearer to the platen roller 2. The wiper member 65 is provided for wiping away ink and foreign matter that cling to the nozzle surface of the heads 41 to 44 that have been subjected suction purge. After suction purge is completed at each head, the ink jet head 40 is moved to a wipe position. Next, the wiper member 65 protrudes in the direction indicated by arrow F4 and wipes the nozzle surface of the heads 41 to 44 as they move toward the recording region. As a result, ink and the like is wiped from the nozzle surface so that the recording surface of the printing sheets P will not be stained by excessive ink.

Figure 3:
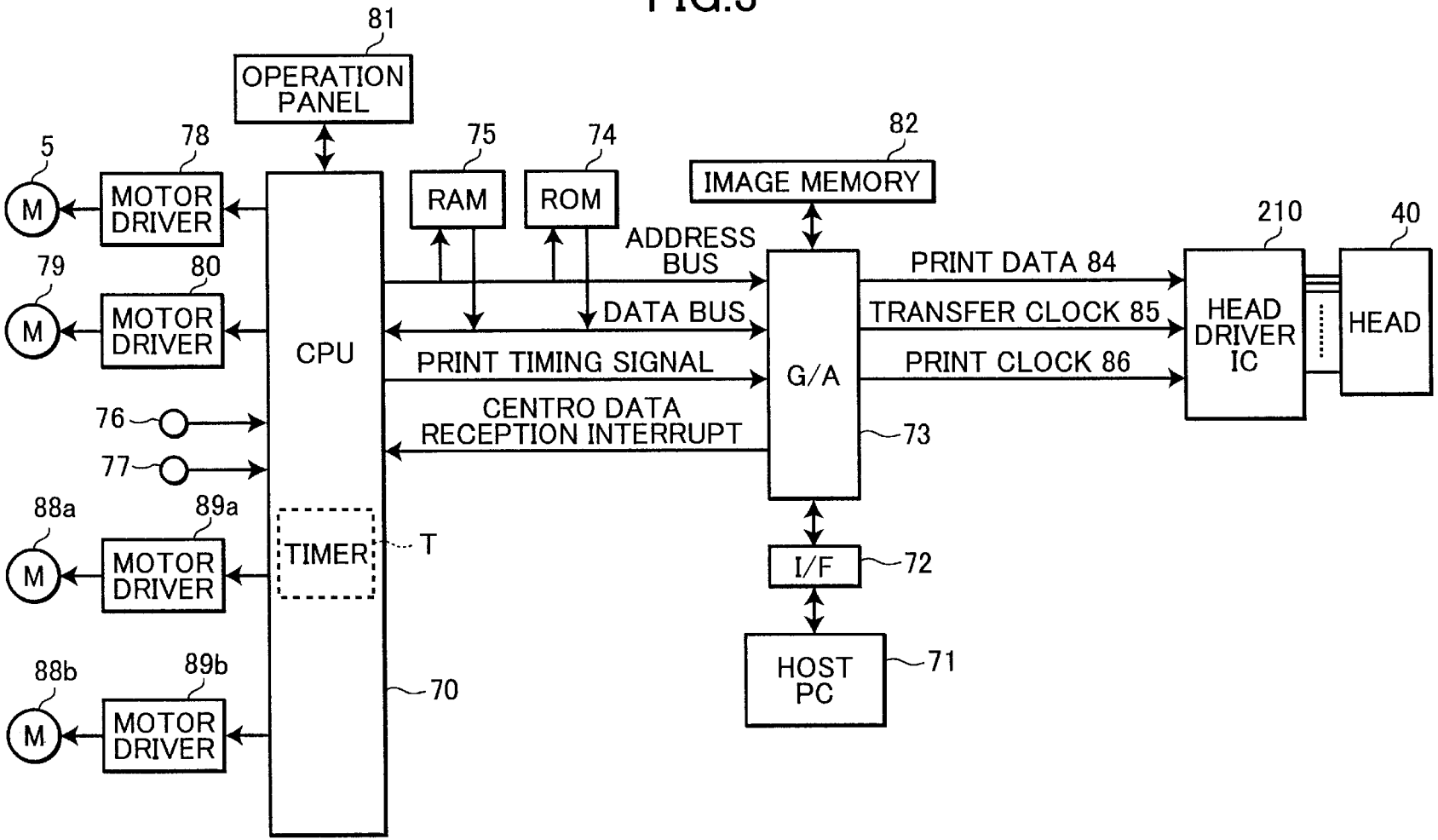
FIG. 3 is a block diagram showing a control system of the ink jet printer according to the embodiment of the invention.

A cap 69 is provided at another side of the suction cap 61 remote from the platen roller 2. The cap 69 is provided for covering the nozzle surface of the heads 41 to 44 of the ink jet head 40 after the ink jet head 40 returns to its home position. When the ink jet head 40 returns to its home position, the cap 69 protrudes in the direction indicated by arrow F5 and covers the nozzle surface of the heads 41 to 44. This prevents the ink in the heads 41 to 44 from drying while the printer is not being used Next, the main control system of the printer will be described while referring to the block diagram of FIG. 3. As shown in FIG. 3, the printer includes a CPU 70 and a gate array (G/A) 73. The CPU 70 is provided for controlling various components of the printer. The gate array 73 receives, through an interface 72, print data transmitted from a host computer 71 and performs control of development of the print data. The CPU 70 includes an internal timer T for measuring timing at which maintenance is to be performed on the ink jet head 40. A ROM 74 and a RAM 75 are connected to both the CPU 70 and the gate array 73. The ROM 74 stores operation programs, a number of ejections to be performed during flushing, and other data previously set. The RAM 75 temporarily stores print data that the gate array 73 has received from the host computer 71.

The CPU 70 is connected to a paper sensor 76, an origin sensor 77, an operation panel 81, and various motor drivers. The paper sensor 76 is provided for detecting presence and absence of a printing sheet P. The origin sensor 77 is provided for detecting whether the ink jet head 40 is at the home position. The motor driver 78 is provided for driving the carriage motor 5. The motor driver 80 is provided for driving a line feed motor 79 used for rotating the platen roller 2. The motor driver 89*a* and 89*b* are provided for driving an ink supply motors 88*a* and 88*b*, respectively. In this embodiment, a buffer purge pump 51 and a suction pump 63 (see FIG. 3) are configured to be selectively driven by switching rotational direction of the ink supply motor 88*a*. An ink supply pump 13 (see FIG. 3) is driven by the ink supply motor 88*b*. The ink supply motors 88*a* and 88*b* supply and circulate black, yellow, cyan and magenta inks in a manner to be described later.

The operation panel 81 is provided for entering a variety of signals to the CPU 70. An image memory 82 is connected to the gate array 73. The image memory 82 is provided for temporarily storing, as image data, print data that was received from the host compute 71. A head driver IC 210 operates to drive the ink jet head 40 based on print data 84, a transfer clock 85, and a print clock 86 output from the gate array 73.

Figure 4:
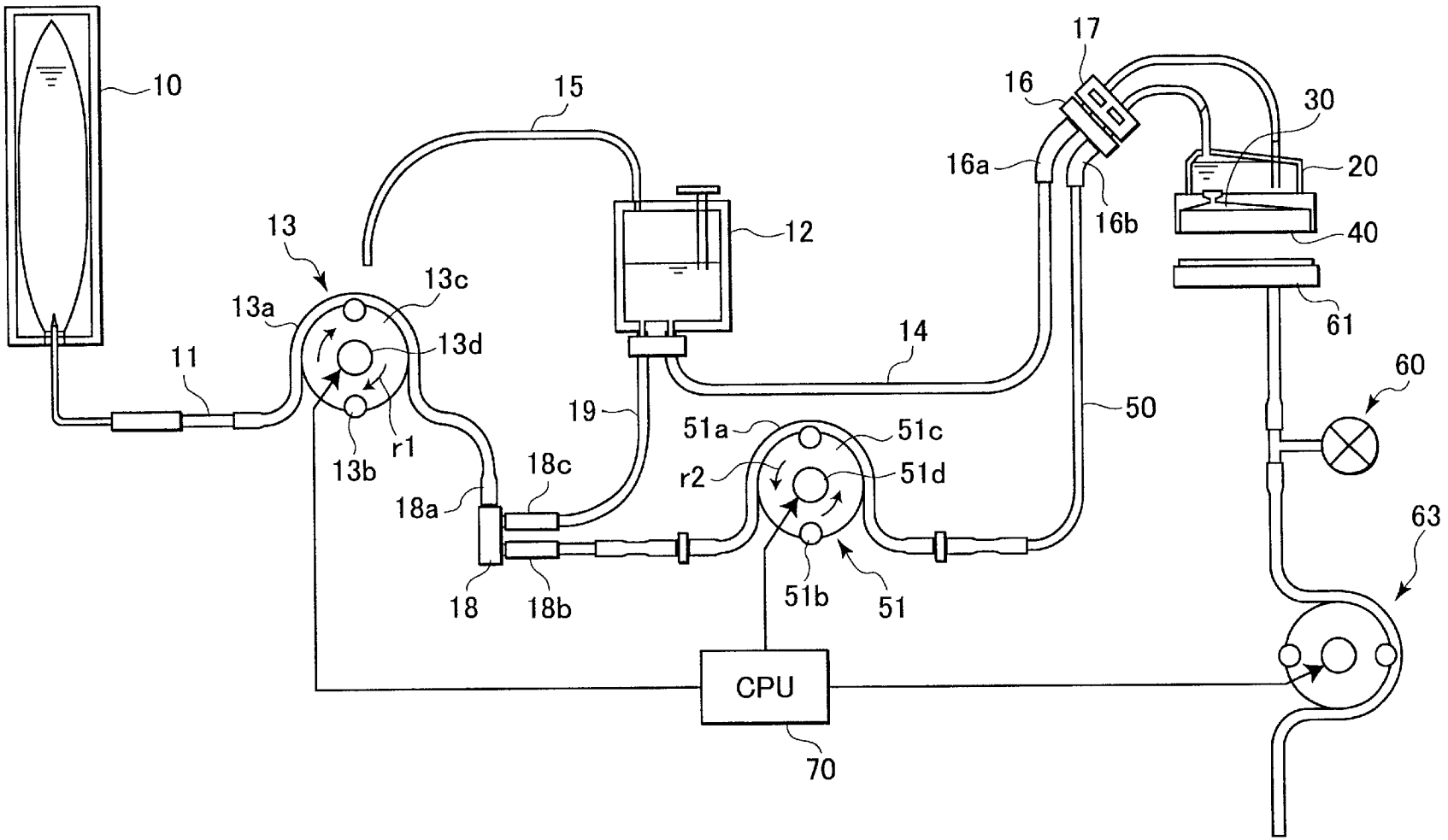
FIG. 4 is an explanatory diagram showing an ink channel of the ink jet printer according to the embodiment of the invention.

FIG. 4 shows an ink channel arrangement of the ink jet printer. An ink cartridge 10 is detachably mounted on the ink jet printer body 1 and contains a predetermined amount of ink The ink cartridge 10 is fluidly connected to a sub-tank 12 through a first supply tube 11, an ink supply pump 13, a third joint 18 to be described later, and a second supply tube 19. Both the first and second supply tubes 11 and 19 are made from a flexible material. The ink cartridge 10 and the sub-tank serve as an ink supply source with respect to the ink jet head 40 to be described later.

The ink supply pump 13 is a conventionally known tube pump. The pump 13 includes a flexible and resilient tube member 13*a*, a plurality of pressurizing members 13*b* (two in the embodiment) for locally pressing the tube member 13*a*, a rotor 13*c* circumferentially supporting the pressurizing members 13*b*, and a motor shaft 13*d* connected to the ink supply motor 88*b*. The motor shaft 13*d* rotates the rotor 13*c*. In accordance with rotations of the rotor 13*c*, the portions on the tube member 13*a* where pressed by the pressurizing members 13*b* shift in a direction indicated by arrows r1, causing an ink flow to be generated from the ink cartridge toward the sub-tank 12.

In this embodiment, because the tube member 13*a* is wound around the rotor 13*c* over 180 degrees or more and two pressurizing members 13*b* are provided at radially opposite positions of the rotor 13*c*, at least one pressurizing member 13*b* is always in pressing contact with the tube 13*a*. As such, when the ink supply pump 13 is stopped, the pressuring member 13*b* interrupts the flow of ink.

Other than the ink supply pump 13, the ink channel arrangement includes two other pumps, a buffer purge pump 51 to be described later, and a suction pump 63. Both the buffer purge pump 51 and the suction pump have a similar arrangement to the ink supply pump 13. The ink supply motor 88*a* for these pumps is connected to the CPU 70 as described previously.

The sub-tank 12 has an upper portion open to atmosphere through an air discharge tube 15. Ink stored in the sub-tank 12 is supplied to a buffer tank 20 through a third flexible supply tube 14, a first joint portion 16 to be described later, and a second joint portion 17. Ink in the buffer tank 20 is supplied to a manifold 30 and the ink in the manifold 30 is in turn distributed to a plurality of ink ejection channels formed in the ink jet head 40. Pressure is selectively applied to ink in ink chambers so that ink droplets are ejected from the corresponding nozzles to form a desired dot pattern.

Air in the upper space of the buffer tank 20 enters into the ink. Therefore, the ink with air bubbles is circulated to the sub-tank 12 through the second joint portion 17, the first joint portion 16, a buffer purge tube 50, the buffer purge pump 51, the third joint 18, and the second supply tube 19.

The buffer purge pump 51 is fluidly connected to the buffer purge tube 50 and creates the flow of ink with air bubbles. The buffer purge pump 51 includes a flexible and resilient tube member 51*a*, a plurality of pressurizing members 13*b* (two in the embodiment) for locally pressing the tube member 51*a*, a rotor 51*c* circumferentially supporting the plurality of pressurizing members 51*b*, and a motor shaft 51*d* selectively connected to the ink supply motor 88*a*. The motor shaft 51*d* rotates the rotor 51*c*. In accordance with rotations of the rotor 51*c*, the portions on the tube member 51*a* where pressed by the pressurizing members 51*b* shift in a direction indicated by arrows r2, causing an ink flow to be generated from the buffer tank 20 toward the sub-tank 12.

The third joint 18 is formed with a first inlet 18*a*, a second inlet 18*b* and an outlet 18*c*. Ink from the ink supply pump 13 is introduced into the third joint 18 via the first inlet 18*a*. Ink and/or air from the buffer purge pump 51 are introduced into the third joint 18 via the second inlet 18*b*. The flow of ink and/or air from the first and second inlets is a and 18*b* are mixed and supplied to the sub-tank 12 through the outlet 18*c*. The outlet 18*c* is fluidly connected to the sub-tank 12 through the second supply tube 19.

The sub-tank 12 has a bottom formed with an ink inlet port to which the second supply tube 19 is connected, and an ink outlet port to which the third flexible supply tube 14 is connected. With such a structure, fresh ink from the ink cartridge 10 does not fall from an elevated position, but is introduced into the sub-tank 12 without generating bubbles and mixing air with the ink. As soon as ink mixed with air and/or ink in which air bubbles are mixed in the buffer purge pump 51 enter into the sub-tank 12 through the inlet port, air and/or bubbles move upwardly with the result that the ink in the sub-tank 12 does not contain air or air bubbles. Ink in the sub-tank 12 is supplied from the outlet port to the buffer tank 20 through the third supply tube 14.

The buffer purge pump 51 stops its pumping operation under certain circumstances including when the ink jet head 40 is ejecting ink droplets at the time of printing or flushing, when the suction pump 63 is performing a suction purging, and when the wiper member 65 is wiping off an ink clinging to the ink jet head 40. When the buffer purge pump 51 is stopped, at least one pressurizing member 51*b* closes the channel so that the buffer tank 20 is held in a hermetically sealed condition. The pressure imparted an the ink jet head 40 is maintained negative due to the difference in height between the ink jet head 40 and the sub-tank 12.

Figure 5A:
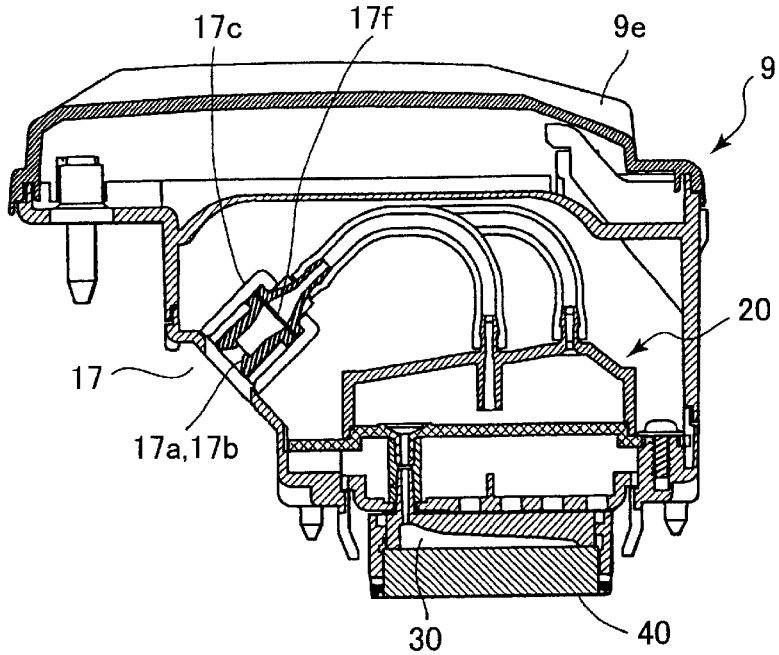
FIG. 5(*a*) is a cross-sectional view showing a head unit.
Figure 5B:
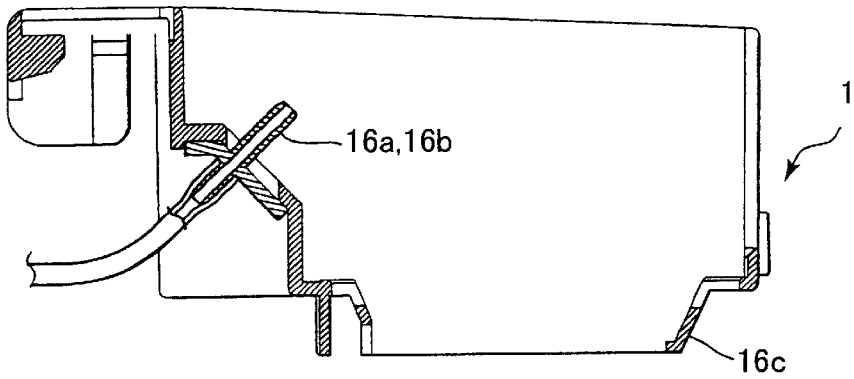
Figure 5C:
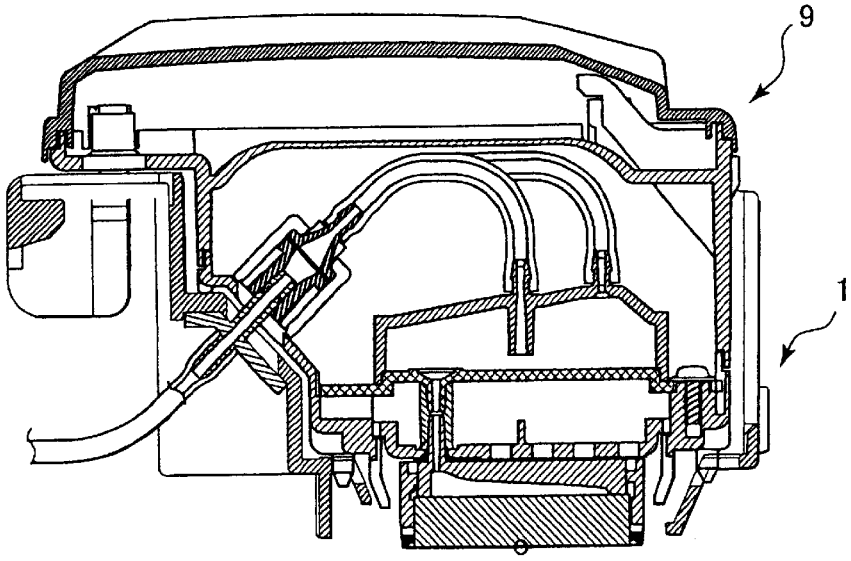
Figure 6:
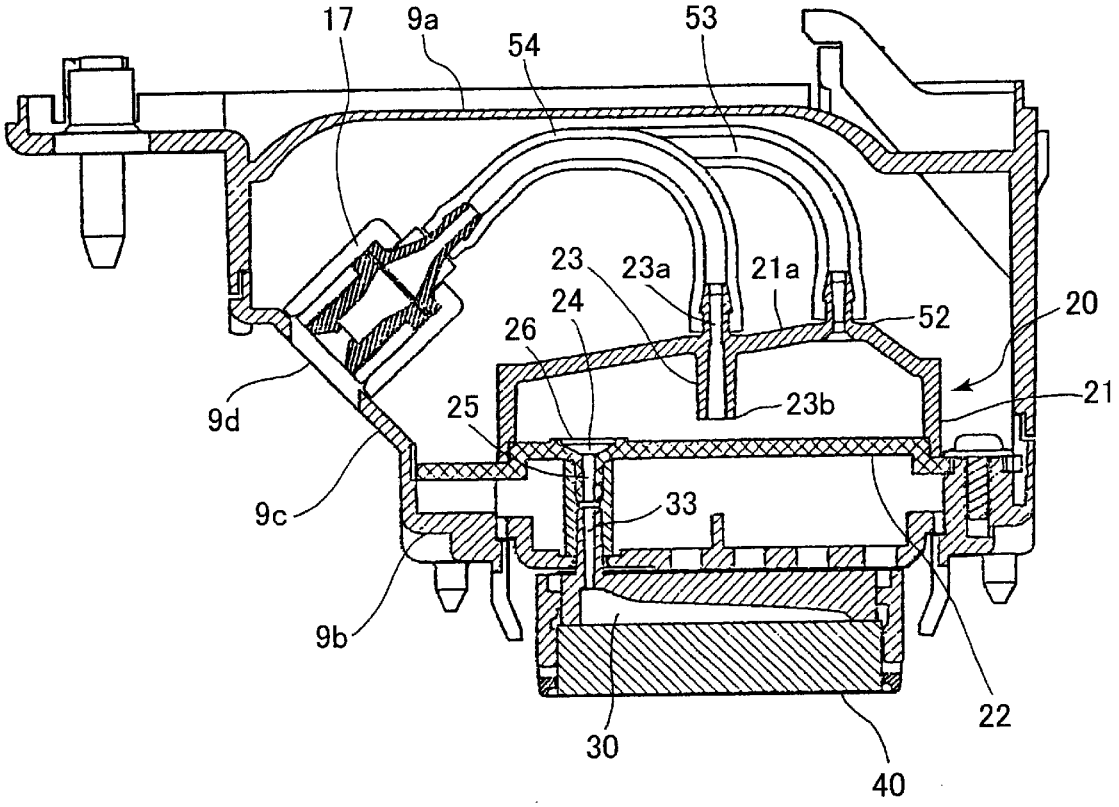
FIG. 6 is an enlarged cross-sectional view showing the head unit.

FIGS. 5(*a*) through 5(*c*) and 6 are cross-sectional views showing a structure of a head unit 9 detachably mounted on the ink jet printer body 1 FIG. 5(*a*) is a cross-sectional view showing the head unit 9. FIG. 5(*b*) is a cross-sectional view showing the structure of the ink jet printer body 1 on which the head unit 9 is to be mounted. FIG. 5(*c*) is a cross-sectional view showing the head unit 9 mounted on the ink jet printer body 1. FIG. 6 is an enlarged cross-sectional view showing the head unit 9.

The head unit 9 includes the second joint portion 17, the buffer tank 20, the manifold 30 and the ink jet head 40, all of which are supported by an upper casing 9*a* and a lower casing 9*b*. A cover 9*e* is attached to the upper surface of the upper casing 9*a* for aesthetic reasons.

The buffer tank 20 is defined by a first casing 21 and a second casing 22, both made by injection molding using a compound resin material. The first casing 21 includes a ceiling wall and side walls, with the lower side open. The second casing 22 is positioned facing and hermetically sealed to the open lower side of the first casing 21, and forms the bottom wall of the buffer tank 20. A hollow tubular wall 23 is formed in the ceiling wall of the first casing 21. The hollow tubular wall 23 extends vertically and protrudes upward out from the buffer tank 20 and downward into the buffer tank 20. An ink introduction port 23*b*, which is the lower end of the hollow tubular wall 23, is disposed near to the inner surface of the second casing 22. An introduction tube 54 is connected to the hollow tubular wall 23. The introduction tube 54 is provided for introducing ink supplied from the sub-tank 12, through the third supply tube 14, into the buffer tank 20.

With this configuration, the ink supplied from the sub-tank 12 is supplied into the buffer tank 20 near the bottom of the buffer tank 20, thereby preventing the ink from dropping from a height and forming bubbles. In particular, introduction of ink will cause almost no disturbance, such as generation of bubbles, when the ink introduction port 23*b* is submerged under the ink.

The manifold 30 is disposed below the buffer tank 20. The manifold 30 is provided for supplying ink to the ink chambers of the ink jet head 40. An ink supply port 24 is formed in the second casing 22, which forms the bottom of the buffer tank 20. A supply pipe 25 is formed on the ink supply port 24 so as to protrude downward. An introduction pipe 33 is formed so as to protrude from the upper side of the manifold 30 at a position corresponding to the position of the supply pipe 25. A filter 26 is disposed on the second casing 22 so as to cover the ink supply port 24. That is, the filter 26, the ink supply port 24, the supply pipe 25, and the introduction pipe 33 configure an ink supply channel for supplying ink from the buffer tank 20 to the manifold 30.

The ceiling wall 21*a* of the first casing 21 of the buffer tank 20 is formed curved surface or with a slanted surface that intersects an imaginary horizontally extending plane. An outflow port 52 is formed in the uppermost portion of the ceiling wall 21*a*. An outflow tube 53 is connected to the outflow port 52. The outflow tube 53 is provided for removing ink mixed with air and bubbles and feeding the ink back into the buffer purge tube 50.

That is, bubbles generated in the ink collect at the uppermost portion of the ceiling wall 21*a* of the buffer tank 20 and are discharged out from the buffer tank 20 through the outflow port 52. In contrast to this, ink in good condition, that is, without any bubbles, accumulates near the bottom surface of the buffer tank 20 and is supplied downward to the manifold 30 through the filter 26. Accordingly, only ink in a good condition, that is, without bubbles or foreign material, is supplied to the ink jet head 40.

As shown in FIG. 5(*a*), the second joint portion 17 is configured from an introduction joint 17*a*, an outflow joint 17*b*, and a joint cover 17*c* The introduction joint 17*a* is connected to the introduction tube 54. The outflow joint 17*b* is connected to the outflow tube 53. The joint cover 17*c* supports the introduction joint 17*a* and the outflow joint 17*b*. In the drawing, the introduction joint 17*a* and the outflow joint 17*b* are aligned in a direction perpendicular to the sheet surface of FIG. 5(*a*). The introduction joint 17*a* and the outflow joint 17*b* are configured in a substantial cylinder shape and are disposed with a tilt of about 35 to 55 degrees from an imaginary vertical line. Accordingly, openings of the introduction joint 17*a* and the outflow joint 17*b* configure an imaginary plane that intersects an imaginary horizontal plane. Also, the introduction joint 17*a* and the outflow joint 17*b* include an internal filter 17*f*.

The lower casing 9*b* includes a slanting surface 9*c* where the second joint portion 17 is located. A vertically extending aperture 9*d* is formed in the slanting surface 9*c*. Because the joint cover 17*c* confronts the slanting surface 9*c*, the openings of the introduction joint 17*a* and the outflow joint 17*b* are disposed at a position confronting the aperture 9*d*. Further, the lower end of the aperture 9*d* and the lower end of the openings of the introduction joint 17*a* and the outflow joint 17*b* are disposed at substantially the same horizontal position.

Accordingly, even if ink drips from the end of the openings of the introduction joint 17*a* and the outflow joint 17*b* when the head unit 9 is detached from the carriage 4, the dripping ink will fall onto the slanting surface 9*c* below the aperture 9*d* and will accumulate in the lower casing 9*b*. Also, the filters 17*f* provided at the introduction joint 17*a* and the outflow joint 17*b* are wet from ink. Therefore, air will not enter into the introduction tube 54 or the outflow tube 53 when the head unit 9 is detached from the carriage 4. The filter 17*f* will prevent most of the ink leak even if ink from the introduction tube 54 or the outflow tube 53 leaks through the openings of the introduction joint 17*a* and the outflow joints 17*b*.

The first joint portion 16 is provided to the carriage 4. The first joint portion 16 is configured from a supply joint 16*a* connected to the introduction joint 17*a*, a circulation joint 16*b* connected to the outflow joint 17*b*, and a mounting portion 16*c*. The mounting portion 16*c* supports the supply joint 16*a* and the circulation joint 16*b* and also supports the head unit 9. As shown in FIG. 4, the supply joint 16*a* is connected to the third supply tube 14. The circulation joint 16*b* is connected to the buffer purge tube 50.

Accordingly, by mounting the head unit 9 onto the mounting portion 16*c*, the introduction joint 17*a* connects S with the supply joint 16*a* and the outflow joint 17*b* connects with the circulation joint 16*b*.

Next, a description will be provided for the ink circulation pathway having the above-described configuration.

When a sensor 12*a* detects that the amount of ink in the sub-tank 12 has reached or gone below a certain fixed amount, then the ink supply pump 13 is drive to supply ink from the ink cartridge 10 into the sub-tank 12 until a predetermined amount of ink has accumulated in the sub-tank 12. This operation is performed independently from operations of the buffer purge pump 51, the suction pump 63, and the ink jet head 40. The ink supply pump 13 is configured from a well-known conventional tube pump as described above, and is either electrically or electromagnetically controlled or mechanically configured so that the rotor 13*c* rotates only in the direction indicated by arrow r1, that is, so that the rotor 13*c* can not rotate in the opposite direction. Accordingly, regardless of whether the ink supply pump 13 is operating or stopped, the flow of ink will not move in the reverse direction toward the ink cartridge 10.

In order to fill the buffer tank 20 and the ink jet head 40 with ink, the CPU 70 controls the suction cap 61 to hermetically seal all of the nozzles in the ink jet head 40 and the buffer purge pump 51 to operate. As a result, a negative pressure is developed within the buffer tank 20 and ink from the sub-tank 12 is efficiently introduced into the buffer tank 20. When the suction pump 63 is driven under control of the CPU 70 after ink has accumulated in the buffer tank 20 to a sufficient height above the ink supply port 24, ink in the buffer tank 20 fills all the ejection channels of the print head 40 from the ink supply port 24. As a result, ink that has all bubbles removed therefrom at the buffer tank 20 is supplied to the ink jet head 40 so that bubbles will not enter the ejection channels of the ink jet head 40.

During various situations, the operation of the buffer purge pump 51 is stopped so that the channel through the buffer purge tube 50 is closed off, thereby bringing the buffer tank 20 into a hermetically sealed condition. These various situations include ink ejection operation of the ink jet head 40, such as during printing and flushing operations, and also include suction purge performed by the suction pump 63 and wiping operations performed by the wiper member 65. As a result, the difference in height between the ink jet head 40 and the sub-tank 12 maintains a negative pressure within the ink jet head 40. When ink is ejected from the ink jet head 40, ink is supplied from the sub-tank 12 to the buffer tank 20 in an amount required to replenished the consumed ink.

At this time, the ink introduction port 23*b* is adjacent to the surface of the second casing 22, which forms the bottom surface of the buffer tank 20, and opens up into the ink so the ink supplied from the ink introduction port 23*b* does not froth up or become filled with air, as would be the case if the ink poured down onto and collided with an ink surface from above.

Periodically, or at an optional timing, the suction cap 61 covers the ejection openings of the ink jet head 4 in a hermetically sealed condition and the buffer purge pump 51 is driven for a predetermined duration of time. By this, any air or bubbles that have accumulated at the upper portion of the buffer tank 20 can be discharged through the introduction port 52. By this, air bubbles that have accumulated at the upper portion of the buffer tank 20 can be efficiently removed. Further, air bubbles generated in the third supply tube 14 is introduced into the buffer tank 20 along with ink so that the air bubbles can be separated from the ink and removed in the above-described manner In the same manner as the ink supply pump 13, the buffer purge pump 51 is configured so that the rotor 51*c* rotates, or is driven to rotate, only in the direction indicated by arrow r2. As a result, ink or air will not flow backwards toward the buffer tank 20, whether the buffer purge pump 51 is being driven or not.

In this way, the buffer purge pump 51 performs ink circulation between the sub-tank 12 and the buffer tank 20 so that clean ink without any air bubbles can be always supplied to the ink jet head 40, without using a valve mechanism or other complicated configuration. Here, the buffer purge pump 51 operates in the direction for generating a negative pressure in the buffer tank 20. Therefore, ink will not leak from the nozzles of the ink jet head 40, even if the amount of ink circulated per unit time is increased to quickly perform ink circulation.

Ink circulation through the ink circulation pathway is not switched by operation of valves but by the operation of the buffer pump 51 configured from a tube pump that car not be operated in reverse. Therefore, the switching operation by the buffer pump 51 will not cause ink to flow in reverse and will not induce fluctuations in ink pressure, which can disrupt the menisci at the nozzles of the print head.

It should be noted that the above-described drive of the buffer purge pump 51 can be performed directly before a suction purge operation (to be described later) or periodically such as after a long duration of time has elapsed (such as once a week) or after a short duration of time has elapsed (such as the time required to print a predetermined number of sheets). If performed periodically, then the timing can be adjusted depending on the ambient temperature. The various tubes of the ink circulation pathway are made from a material penetrable by gases. When the printer has not been operated for long periods of time, gas can pass through the tubes so that bubbles are generated throughout the ink circulation pathway. In such a situation, a large volume of ink can be circulated so that air bubbles from the third supply tube 14 and the head unit 9 accumulate at the upper portion of the sub-tank 12, and are removed from the third supply tube 14 and the head unit 9.

Figure 7:
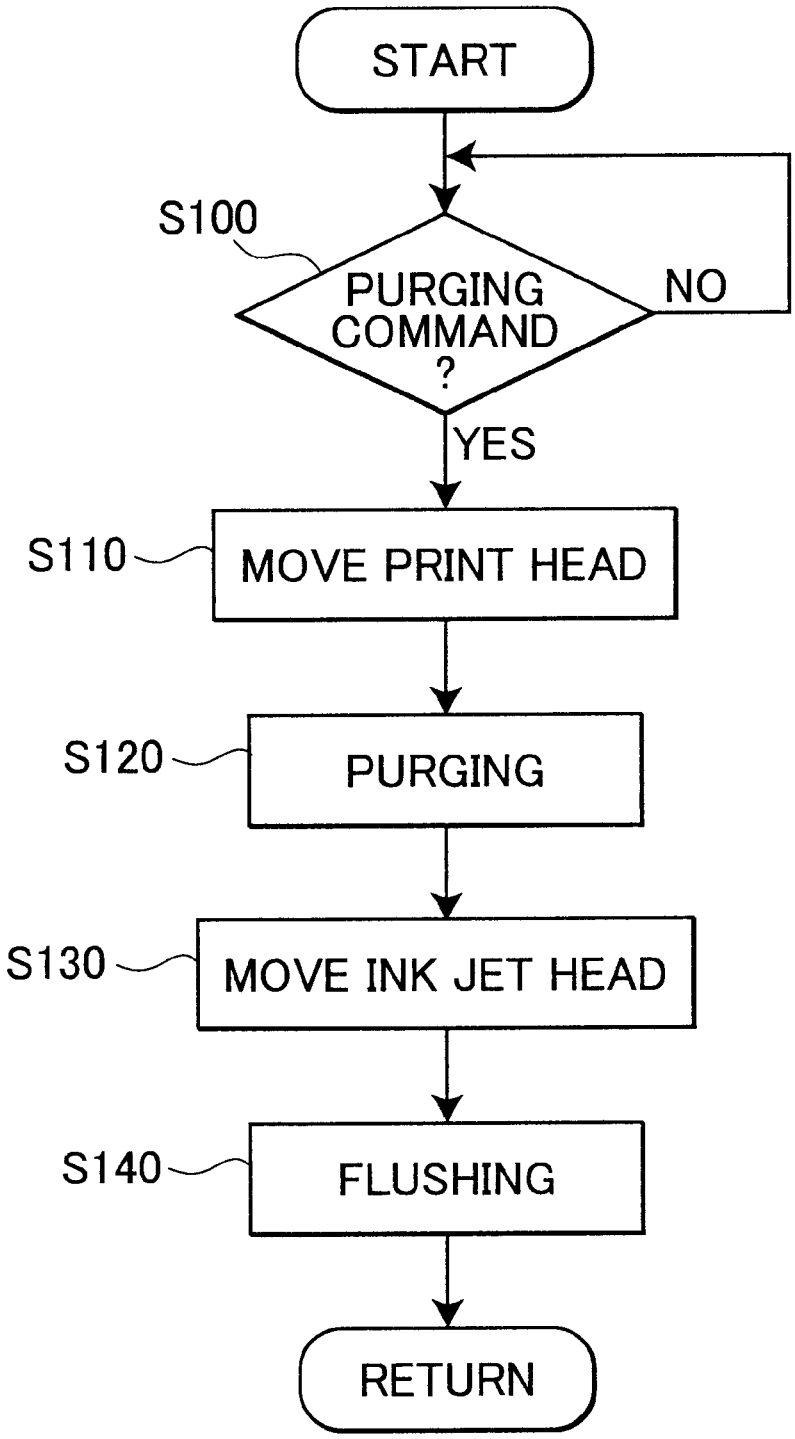
FIG. 7 is a flowchart illustrating control processes of purging and flushing operations.

Next, control operations performed by the CPU 70 during suction purge and flushing will be described with reference to the flowchart of FIG. 7.

The suction purge operation can be started under a variety of situations. For example, the suction purge operation can be performed before a printing operation is started. In this case, the suction purge can be changed in accordance with the duration of the non-use period before the printing operation, that is, in accordance with the duration of time measured by the timer T of the CPU 70. Also, the suction purge can be performed after an ink cartridge is exchanged in order to suck ink from the new cartridge into the head using the suction pump 63. Alternatively, the suction purge operation can be performed when a user presses an operation key upon discovering defective ink ejection.

When the signal of the suction purge command is automatically or optionally output in the above-described manner (S100), then the ink jet head 40 is moved to the purge position facing the suction cap 61 (S110). Then the suction cap 61 is driven to cover the nozzle surface of the ink jet head 40. After the buffer purge pump 51 is stopped, the suction pump 63 is driven to suck ink from the nozzles of the ink jet head 40 (S120). This suction purge operation suck defective ink, which includes bubbles, from the ink chambers of the ink jet head 40.

When the suction purge operation is completed, then the ink jet head 40 is moved to the flushing position via the wiping position (S130). During this operation, the buffer purge pump 51 remains turned off. When the ink jet head 40 moves past the wiping position, the wiper member 65 wipes the nozzle surface. Then flushing is performed by ejecting ink from the ink chambers toward the ink absorption pad 8

(S140). During the flushing operation, the buffer purge pump 51 is turned off. The flushing operation reliably ejects, along with the ink, any bubbles that entered the ink chambers during suction purge.

While the invention has been described in detail with reference to specific embodiments thereof, it would be apparent to those skilled in the art that various changes and modifications may be made therein without departing from the spirit of the invention, the scope of which is defined by the attached claims.

For example, FIG. 1 shows a configuration wherein the ink jet head 40 ejects ink downward at printing sheets P that are transported in a substantially horizontal direction. However, the ink can be ejected in any direction as long as the positional relationship of the buffer tank 20, the manifold 30, and the ink jet head 40 in the vertical direction is maintained.

Also, the ink jet head 40 of FIG. 1 includes a black head 41 for ejecting black ink, a yellow head 42 for ejecting yellow ink, a cyan head 43 for ejecting cyan ink, and a magenta head 44 for ejecting magenta ink. However, the ink jet head 40 can be modified for ejecting three, two, or even one color of ink as long as the general configuration is maintained.

A variety of different printing methods can be applied for the printer. For example, printing can be performed on a line basis by scanning the carriage 4 across the printing sheet P in the directions indicated by arrows F7, F8 to scan the ink jet head 40 across the surface of the paper P, then feeding the paper P by a predetermined amount in the direction indicated by F2 and again scanning the ink jet head 40 in the directions indicated by arrows F7, F8. Alternatively, printing can be performed by first moving the carriage 4 to a predetermined position, then afterward moving only the printing sheet P in the direction F2 during printing while the carriage 4 is maintained stationary.

In the embodiment as described above, a tube pump is used in the suction pump 63. However, a conventionally known cylinder pump can be used in lieu of the tube pump. It is also possible not to provide its own motor to operate the suction pump 63 but to use the motor 88*b* of the ink supply pump 13 as the driving source of the suction pump 63. To this end, the motor 88*b* is switched so as to selectively drive the suction pump 63 and the ink supply pump 13. Or, by providing its own motor to the buffer purge pump 51, the motor of the buffer purge pump 51 may be switched so as to selectively drive the suction pump 63 and the buffer purge pump 51. This switching operation can be achieved by the use of, for example, a planetary gear mechanism that rotates the platen roller 2 when the line feed motor 79 is driven to rotate forward and drive the suction pump 63 when the line feed motor 79 is driven to rotate in reverse.

What is claimed is:

1. A head unit for an ink jet printer having an ink jet printer body and a sub tank being mounted on the ink jet printer, the head unit being detachably mounted on the ink jet printer body, the head unit comprising:

an ink head formed with a plurality of ink chambers, and a plurality of nozzles fluidly connected to respective ones of the plurality of ink chambers individually;

a manifold fluidly connected to the plurality of ink chambers, ink being supplied from the manifold to the plurality of ink chambers;

a buffer tank defined by a ceiling wall, side walls, and a bottom wall, the buffer tank having an inner space defined by an inner surface of the ceiling wall, inner surfaces of the side walls, and an inner surface of the bottom wall with the buffer tank in fluid communication with the sub tank to allow ink to be supplied from the sub tank to the buffer tank, the inner surface of the ceiling wall having an uppermost portion and a lowermost portion, wherein at the uppermost portion, an outflow port is formed, the outflow port being fluidly connected, when the head unit is mounted on the ink jet printer body, through an ink circulation pathway to the sub tank for removing air and ink mixed with bubbles from the buffer tank; and an ink supply channel fluidly connected between the buffer tank and the manifold, wherein ink stored in the buffer tank is supplied to the manifold and the ink in the manifold is in turn supplied to the plurality of ink chambers for allowing ink droplets to be ejected from the plurality of nozzles.

2. The head unit according to claim 1, wherein said manifold is positioned below said buffer tank when the head unit is disposed in an orientation in which the head unit is intended to be used.

3. The head unit according to claim 2, wherein said ink head is positioned below said manifold when the head unit is disposed in an orientation in which the head unit is intended to be used.

4. The head unit according to claim 3, wherein the bottom wall of said buffer tank is formed with a first aperture, said manifold has an upper surface formed with a second aperture, and said ink supply channel is provided between the first aperture and the second aperture.

5. The head unit according to claim 4, further comprising a filter disposed in said ink supply channel.

6. The head unit according to claim 1, wherein the inner surface of said ceiling wall is formed with a curved surface or with a slanted surface that intersects an imaginary horizontally extending plane.

7. The head unit according to claim 1, wherein an ink introduction port is formed in said buffer tank for introducing ink into said buffer tank, the ink introduction port being disposed near to the inner surface of said bottom wall.

8. The head unit according to claim 7, wherein said ink introduction port comprises a hollow tubular wall, said hollow tubular wall being formed in the ceiling wall to protrude downward into said buffer tank.

9. The head unit according to claim 1, further comprising:

an ink introduction port formed in said buffer tank for introducing ink into said buffer tank;

an introduction tube fluidly connected to said ink introduction port for introducing ink into said ink introduction port;

an introduction joint having one end fluidly connected to said introduction tube and another end fluidly connected to said ink circulation pathway provided in said ink jet printer body, ink supplied from said ink circulation pathway being introduced into said introduction tube via said introduction joint;

an outflow port formed in said buffer tank;

an outflow tube fluidly connected to said outflow port for removing air and ink mixed with bubbles from said buffer tank; and an outflow joint having one end fluidly connected to said outflow tube and another end fluidly connected to said ink circulation pathway provided in said ink jet printer body, the air and ink mixed with bubbles being fed back into said ink circulation pathway via said outflow joint, wherein said another end of said introduction joint is brought into connection with said ink circulation pathway and said another end of said outflow joint is brought into connection with said ink circulation pathway when said head unit is mounted on said ink jet printer body whereas said another end of said introduction joint is disconnected from said ink circulation pathway and said another end of said outflow joint is disconnected from said ink circulation pathway when said head unit is detached from said ink jet printer body.

10. The head unit according to claim 9, wherein said introduction joint includes a filter.

11. The head unit according to claim 9, wherein said introduction joint and said outflow joint have openings facing said ink jet printer body, the openings configuring an imaginary plane that intersects an imaginary horizontal plane.

12. The head unit according to claim 11, further comprising a casing disposed below the openings of said introduction joint and said outflow joint.

13. The head unit according to claim 12, wherein said casing is a part of a casing of said head unit.

14. An ink jet printer comprising:

a head unit; and an ink jet printer body, said head unit being detachably mounted on said ink jet printer body, wherein said head unit comprises:

an ink head formed with a plurality of ink chambers and a plurality of nozzles fluidly connected to respective ones of said plurality of ink chambers individually;

a manifold fluidly connected to said plurality of ink chambers, ink being supplied from said manifold to said plurality of ink chambers;

a buffer tank defined by a ceiling wall, side walls, and a bottom wall, said buffer tank having an inner space defined by an inner surface of said ceiling wall, inner surfaces of said side walls, and an inner surface of said bottom wall; and an ink supply channel fluidly connected between said buffer tank and said manifold, wherein ink stored in said buffer tank is supplied to said manifold and the ink in said manifold is in turn supplied to said plurality of ink chambers for allowing ink droplets to be ejected from said plurality of nozzles, wherein said ink jet printer body comprises:

an ink supply source storing ink;

a first ink channel for supplying the ink of said ink supply source to said buffer tank;

a second ink channel for feeding back the ink stored in said buffer tank to said ink supply source; and a buffer purge pump disposed in said second ink channel, said buffer purge pump generating a flow of ink from said buffer tank to said ink supply source when driven and interrupting the flow of ink when stopped.

15. The ink jet printer according to claim 14, wherein said buffer purge pump is stopped when ink droplets are ejected from any one of said plurality of nozzles.

16. The ink jet printer according to claim 14, further comprising a suction cap movable toward said ink head to hermetically seal said plurality of nozzles, and a suction pump connected to said suction cap, said suction pump sucking ink in said plurality of ink chambers through said suction cap.

17. The ink jet printer according to claim 16, wherein said buffer purge pump interrupts the flow of ink when said suction pump is sucking ink in said plurality of ink chambers through said suction cap.

18. The ink jet printer according to claim 14, wherein said ink supply source comprises an ink cartridge detachably mounted on said ink jet printer body, a third ink channel, and a sub-tank fluidly connected to said ink cartridge through said third ink channel, said sub-tank storing ink supplied from said ink cartridge, and further comprising an ink supply pump disposed in said third ink channel, said ink supply pump generating a flow of ink from said ink cartridge to said sub-tank when driven and interrupting the flow of ink when stopped, wherein said first ink channel supplies the ink of said sub-tank to said buffer tank, and said second ink channel feeds back the ink stored in said buffer tank to said sub-tank.

19. The ink jet printer according to claim 18, further comprising a joint having a first inlet, a second inlet and an outlet, wherein said third ink channel is divided into a first part and a second part, said first part being connected at one end to said ink cartridge and another end to said first inlet, said second part being connected at one end to said outlet and another end to said sub-tank, and wherein said second ink channel is divided into a first part and a second part, said first part of said second ink channel being connected at one end to said buffer tank and another end to said second inlet, said second part of said first ink channel being commonly used as said second part of said second ink channel.

20. The ink jet printer according to claim 14, wherein said buffer purge pump comprises a tube pump.

21. An ink jet printer, comprising:

an ink head formed with a plurality of ink chambers, and a plurality of nozzles fluidly connected to respective ones of the plurality of ink chambers individually;

a manifold fluidly connected to the plurality of ink chambers, ink being supplied from the manifold to the plurality of ink chambers;

a buffer tank having a ceiling with an uppermost portion and a lowermost portion wherein an outflow port is formed at an uppermost portion thereof a sub tank;

an ink supply channel fluidly connected between the buffer tank and the manifold and between the sub tank and the buffer tank, wherein ink stored in the sub tank is supplied to the manifold through the buffer tank and the ink in the manifold is in turn supplied to the plurality of ink chambers for allowing ink droplets to be ejected from the plurality of nozzles; and an ink circulation pathway fluidly connected between the outflow port of the buffer tank and the sub tank, for removing air and ink mixed with bubbles from the buffer tank.

* * * * *